US010500622B2

(12) United States Patent
Fuchs et al.

(10) Patent No.: US 10,500,622 B2
(45) Date of Patent: Dec. 10, 2019

(54) SYSTEM, COIL TRANSPORT VEHICLE, METHOD FOR DISCHARGING A COIL WOUND ON A WINDING SYSTEM

(71) Applicant: SMS Group GmbH, Duesseldorf (DE)

(72) Inventors: Wolfgang Fuchs, Hilchenbach (DE); Helmut Hoefer, Hilchenbach (DE); Andreas Kastner, Kirchhundem (DE); Carsten Heide, Netphen (DE); Martin Luebke, Erndtebrueck (DE); Thomas Holzhauer, Kirchhundem (DE)

(73) Assignee: SMS Group GmbH, Duesseldorf (DE)

( * ) Notice: Subject to any disclaimer, the term of this patent is extended or adjusted under 35 U.S.C. 154(b) by 227 days.

(21) Appl. No.: 15/571,304

(22) PCT Filed: Apr. 29, 2016

(86) PCT No.: PCT/EP2016/059596

§ 371 (c)(1),
(2) Date: Nov. 2, 2017

(87) PCT Pub. No.: WO2016/177634

PCT Pub. Date: Nov. 10, 2016

(65) Prior Publication Data

US 2018/0354010 A1 Dec. 13, 2018

(30) Foreign Application Priority Data

May 4, 2015 (DE) ..... 10 2015 208 220

(51) Int. Cl.
*B21C 47/24* (2006.01)
*B21C 47/04* (2006.01)
(Continued)

(52) U.S. Cl.
CPC ..... *B21C 47/24* (2013.01); *B21B 39/02* (2013.01); *B21C 47/04* (2013.01); *B21C 47/326* (2013.01)

(58) Field of Classification Search
CPC ..... B21B 39/02; B21C 47/24; B21C 47/04; B21C 47/326; B65H 19/126; B65H 2301/4172; B65H 2405/422
See application file for complete search history.

(56) References Cited

U.S. PATENT DOCUMENTS 2,038,660 A * 4/1936 Kretzschmar ..... D02H 13/38 254/2 C
3,077,317 A * 2/1963 Angst ..... B21C 47/24 242/533.3
(Continued)

FOREIGN PATENT DOCUMENTS

DE 1934336 1/1969
DE 9303415 7/1993
(Continued)

*Primary Examiner* — William A. Rivera
(74) *Attorney, Agent, or Firm* — Abelman, Frayne & Schwab

(57) ABSTRACT

The invention relates to a coil transport pallet (8) for transporting a wound coil (6), with a support device (35) for temporarily supporting the wound coil (6), with a coupling unit (40) for coupling to a coil transport vehicle (11) and/or with rolling and/or sliding surfaces (29) for interaction with a ground conveyor device (15), wherein the coil transport pallet (8) has a through-opening (50) for guiding a pressing element (51) of a pressing mechanism (52) therethrough, for pressing at least one winding layer (49) and/or winding layer end (78) against the wound coil (6).

11 Claims, 5 Drawing Sheets

Figure 1:
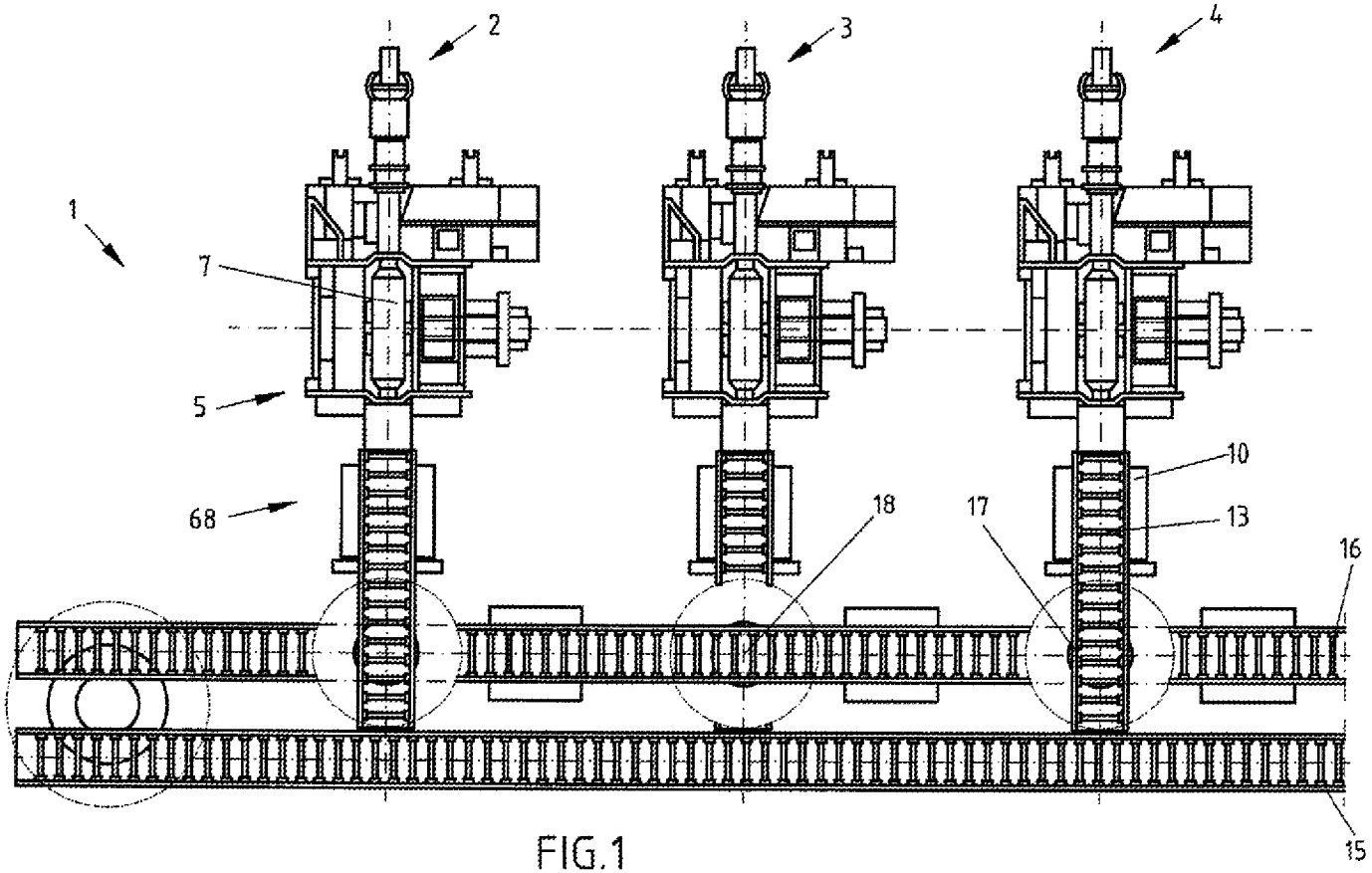

(51) Int. Cl.
*B21C 47/32* (2006.01)
*B21B 39/02* (2006.01)

(56) References Cited

U.S. PATENT DOCUMENTS 3,818,737 A * 6/1974 Kajiwara ..... B21C 47/02 72/134
4,131,206 A * 12/1978 Kawada ..... B65H 19/126 242/559.4
4,854,806 A * 8/1989 Gertsch ..... B65H 19/126 414/495
4,948,060 A * 8/1990 Kurz ..... B65H 19/105 242/552
5,004,173 A * 4/1991 Kawai ..... B65H 19/126 242/559.1
5,365,856 A 11/1994 Richert
5,746,077 A * 5/1998 Zaccagni ..... B21C 47/24 242/557
5,794,885 A * 8/1998 Husek ..... D03D 49/20 139/304
5,934,604 A * 8/1999 Klimek ..... B65H 16/06 242/557
6,230,752 B1 * 5/2001 Dornier ..... D03D 49/00 139/1 R
6,264,417 B1 * 7/2001 Salsburg ..... B21C 47/24 242/563
10,150,402 B2 * 12/2018 White ..... B60P 1/16
2012/0317774 A1 12/2012 Balmer
2013/0256439 A1 10/2013 Cramer
2013/0327735 A1 12/2013 Kaneta

FOREIGN PATENT DOCUMENTS

DE 102012215369 3/2014
JP 505342 3/1975
JP 2011020761 2/2011
WO WO-2013079081 A1 * 6/2013 ..... B65G 25/02

* cited by examiner

SYSTEM, COIL TRANSPORT VEHICLE, METHOD FOR DISCHARGING A COIL WOUND ON A WINDING SYSTEM

RELATED APPLICATIONS

This application is a National Stage application of International Application PCT/EP2016/059596 filed Apr. 29, 2016 and claiming priority of German Application DE 10 2015 208 220.2 filed May 4, 2015, both application being incorporated herein by reference thereto.

The invention relates to a coil transport pallet for transporting a wound coil, with a support device for temporarily supporting the wound coil, with a coupling unit for coupling to a coil transport vehicle and/or with rolling and/or sliding surfaces for interaction with a ground conveyor device.

The invention further relates to a coil transport vehicle, in particular a coil discharge carriage, with a pallet accommodation for accommodating a coil transport pallet.

The invention furthermore relates to a method for discharging a coil wound on a winding system, in particular a coil wound from a steel strip, in which at least one winding layer and/or winding layer end of the wound coil is/are pressed by means of a pressing mechanism against the wound coil, in which the wound coil is deposited on a coil transport vehicle, in particular on a coil discharge carriage, in order to discharge this wound coil from the winding system and provide it for further processing.

In the prior art, there are many coil discharge and coil transport options by means of which a coil wound on a winding system can be discharged from this winding system and transported for further processing directly to a corresponding further processing system or to a temporary storage where the wound coil can be stored temporarily.

In particular in the case of wound coils made of a material strip of greater strength such as a steel strip, for example, there is an increased risk that the wound coil "springs open" accidentally; that is to say that at least the outer curved winding layers of the coil unbend again partially, resulting at least in making the further processing of this wound coil considerably more difficult. In order to prevent such a springing open of the wound coil, the wound coil is firmly tied immediately after the winding with the aid of a tying machine. This tying by means of appropriate tying elements is not only costly and time consuming, but it also entails additionally the disadvantage that the wound coil can be damaged on its outer side. In addition, in the handling of the wound coil, associated tying elements of a corresponding tying can be damaged, resulting in the risk that the wound coil could unexpectedly spring open during coil transport and, in the process, it could even injure personnel in the worst case.

Furthermore, during coil transport between the winding system and the further processing system or the temporary storage, the wound coil is commonly often transferred multiple times. More precisely, during coil transport, the wound coil is at various times picked up, deposited, transported further, picked up again, etc. However, due to this handling, there is also an increase in the risk that the wound coil is damaged, for example, by a discharge device provided on the winding system, by means of which the wound coil is discharged from the winding system and/or already due to a multitude of deposition marks, which can easily be produced on the outer winding layer of the coil, in particular when it is deposited repeatedly at different times onto different supports. This disadvantage is already remedied by transporting the coil on a coil transport pallet as coil/pallet unit.

In addition, it is a considerable disadvantage if the windings are shifted among themselves due to frequent lifting and lowering of the wound coil during coil transport and the individual winding layers loosen as a result. This has an extremely disadvantageous effect on the shape stability of the wound coil, further increasing the risk of mechanical damage to the wound coil. This disadvantage too can be counteracted by coil transport by means of a coil transport pallet.

In particular, the underlying aim of the invention is to further develop the discharge process at the end of a coil winding process on a winding system, so that the above-mentioned disadvantages in particular can be overcome.

The aim of the invention is achieved by a coil transport pallet for transporting a wound coil, with a support device for temporarily supporting the wound coil, with a coupling unit for coupling to a coil transport vehicle and/or with rolling and/or sliding surfaces for interaction with a ground conveyor device, wherein the coil transport pallet has a through-opening for guiding a pressing element of a pressing mechanism therethrough, for pressing at least one winding layer and/or winding layer end against the wound coil.

By means of this through-opening provided on the coil transport pallet, a pressing mechanism can interact in a manner not known to date with the wound coil which is held by the winding mandrel, so that the entire discharge process for discharging the finished wound coil from the winding system can be designed more simply.

In particular, a coil/pallet unit can be produced advantageously by means of the present coil transport pallet.

The term "coil/pallet unit" in the sense of the invention describes a unit which consists substantially of the above coil transport pallet and of a wound coil associated with said coil transport pallet on a winding system for coil transport, wherein the coil is deposited temporarily on the coil transport pallet in an operationally reliable manner.

In particular, the present novel coil transport pallet allows another placement possibility of the pressing mechanism and thus also a new design of a device for discharging a coil wound on a winding system, as explained in further detail below.

In any case, the coil transport pallet has a pressing element through-opening, so that at least the outer winding layer and/or the outer winding layer end of the wound coil can be pressed by means of a pressing element through the coil transport pallet against the wound coil.

This is already achieved while the wound coil in the winding system and, with the removal from the winding mandrel of the winding system, is deposited on the coil transport pallet.

Thus, the coil transport pallet in the sense of the invention forms a pressing element through-opening which is specifically adjusted to the size of the pressing element in such a manner that said pressing element can be passed through the coil transport pallet to the wound coil.

In the sense of the invention, the present coil transport pallet is preferably a coil transport pallet which can be associated, in particular, with a coil transport vehicle implemented as coil discharge carriage.

It should be understood that the present through-opening can have a wide variety of designs in order to allow, in particular, an interaction of the pressing element of the pressing mechanism arranged on the coil transport vehicle with the coil.

The through-opening can be implemented in a manner which is particularly advantageous and easily accessible from a structural standpoint if it is surrounded at least partially, preferably completely, by the construction of the support device.

In particular, if the construction of the support device completely surrounds the through-opening, the through-opening can be enclosed by the support device in the form of a closed ring, so that the construction of the support device is particularly stable.

To that extent, it is advantageous if the construction of the support device surrounds the through-opening is at least partially.

The support device of the coil transport pallet is here designed in such a manner that the wound coil coming from the winding mandrel can be deposited reliably. To that extent, the support device is used for removing and supporting the wound coil on the coil transport pallet.

The coupling surfaces of the coupling unit provided on the coil transport pallet are preferably arranged on the lower side of the coil transport pallet or so that they are accessible from the lower side and they are part of the coupling unit, by means of which the coil transport pallet can be temporarily coupled in an operationally reliable manner to the coil transport vehicle.

The rolling and/or sliding surfaces are also preferably arranged on the lower side of the coil transport pallet. These rolling and/or sliding surfaces can interact with a correspondingly complementary formed forced guidance device, for example, the stationary ground conveyor device, if the coil transport pallet is to be transported on the present ground conveyor device.

Preferably, the coil transport pallet has a rollerless design, so that the rolling and/or sliding surfaces are implemented, for example, by runners or the like, which can move satisfactorily along a roller table lane of the stationary ground conveyor device.

In the present case, the coil transport vehicle is designed to be mobile and the ground conveyor device is designed to be stationary.

The present through-opening can be placed on the coil transport pallet advantageously with regard to the pressing mechanism, if the through-opening is arranged between two coupling spaces spaced from one another by the through-opening and/or between two runners spaced from one another by the through-opening and forming the rolling and/or sliding surfaces. As a result, the pressing element can advantageously interact with the wound coil in order to produce a coil/pallet unit in an uncomplicated and operationally reliable manner.

The construction of the coil transport pallet can be further simplified from a structural standpoint if the through-opening is arranged beneath the support device. As a result, in particular, the pressing element of the pressing mechanism can be guided satisfactorily from below against the wound coil, when the coil transport pallet is on the coil transport vehicle.

In particular, it is advantageous if the through-opening is arranged on a side of the coil transport pallet facing the coil transport vehicle.

The coil/pallet unit can be produced particularly simply, if the through-opening is arranged in a trough of the support device. As a result, the pressing element can be led from beneath the trough to the wound coil.

The trough here forms a depression on the support device or on the coil transport pallet, so that the wound coil can be placed particularly deep in (the coil transport pallet and thus can also be arranged as close as possible to the coil transport vehicle.

Therefore, it is advantageous if the pressing element or the pressing roller is designed as a trough roller element which is arranged in the trough.

Finally, to that extent it is advantageous if the through-opening is arranged on the lower side of the coil transport pallet, since, as a result, the pressing mechanism can be guided in a conceptually simple manner to the wound coil.

In other words, arranged on the lower side means that the through-opening is arranged in a plane defined by the longitudinal and transverse extent of the coil transport pallet, wherein this through-opening perforates this plane in such a manner that the coil transport pallet can be physically penetrated particularly from below.

The through-opening thus opens the coil transport pallet downward, and, in particular, in such a way that the coil transport pallet can be penetrated at least partially from below by the pressing mechanism.

Furthermore, it is advantageous if the through-opening has a longitudinal orientation oriented in the direction of the longitudinal extent of the coil transport pallet. As a result, the through-opening can be oriented substantially axially parallel to the longitudinal extent and in particular to the preferred transport direction of the coil transport pallet.

If the through-opening has a longitudinal orientation oriented in the direction of the longitudinal extent of a coil accommodation space formed by the support device, the pressing element can interact without problem with the coil preferably over the entire coil width, as a result of which the coil/pallet unit can be produced with qualitatively higher value.

In the same way, an advantageous effect on the production of the coil/pallet unit can be obtained if the through-opening has a longitudinal orientation oriented in the direction of the coil rotation axis of a coil deposited on the support device.

A good interaction between the wound coil and the pressing mechanism can moreover be promoted if the through-opening has a longitudinal orientation oriented in the direction of the rotation axis of the pressing element.

The structure of the coil discharge pallet can be designed even more advantageously if the through-opening is arranged so that it extends transversely to a coil tying direction provided on the coil transport pallet and/or transverse to a coil tying opening arranged on the coil transport pallet.

In particular, the coil transport pallet and especially the support device can be designed with bar elements in such a manner that the wound coil can be deposited on small-construction fork elements, which provides a reduced deposition surface for the wound coil. The gap between the bar elements and the fork elements can here be used for arranging the through-opening for guiding through of the pressing element of the pressing mechanism for pressing at least one winding layer and/or winding layer end against the coil.

The design of the proposed coil transport pallet ensures, in particular, a particularly reliable coil accommodation and also provides, if necessary or desirable, a good possibility of additionally tying the wound coil on the coil transport pallet. Moreover, there is also the possibility of further processing in a coil inspection.

Furthermore, as described, the discharge process can be significantly improved if the through-opening provided on the coil transport pallet is arranged with respect to the coil transport vehicle in such a manner that a pressing mechanism arranged on the coil transport vehicle can be guided at least partially through this through-opening, so that its pressing elements can interact with the wound coil independently of the site at which the finished wound coil is retained. It is not important here whether the wound coil is located still inside or outside of the winding system.

To that extent, a preferred embodiment variant provides that the pressing element can interact with the wound coil both inside and outside of the winding system. More precisely, in the present case, the pressing mechanism can interact with the wound coil if the wound coil, on the one hand, is still held inside the winding system on a winding mandrel and if the wound coil, on the other hand, is deposited on the coil transport vehicle and possibly transported out of the winding system by means of said coil transport vehicle.

In this connection, the aim of the invention is also achieved by a coil transport vehicle, in particular by a coil discharge carriage, with a pallet accommodation for accommodating a coil transport pallet, wherein the coil transport vehicle comprises a pressing mechanism with a displaceable pressing element for pressing at least one winding layer and/or winding layer end against the wound coil, and wherein the displaceable pressing element is mounted linearly displaceably with respect to the coil transport vehicle on said coil transport vehicle.

By means of such a coil transport vehicle, the discharge process can be implemented very simply in terms of construction using the present coil transport pallet.

A preferred embodiment variant provides that the displaceable pressing element is arranged on the coil transport vehicle linearly displaceably in such a manner that it can be displaced vertically through a through-opening formed on the coil transport pallet. Thus, the displaceable pressing element can advantageously be guided through the through-opening arranged beneath the support device.

The term "vertical" in the present case describes a movement of the displaceable pressing element, which has a component in vertical direction.

Another advantageous embodiment variant provides that the displaceable pressing element is arranged on the coil transport vehicle linearly displaceably with respect to a pallet moving device of the coil transport vehicle, wherein by means of the pallet moving device a coil transport pallet received by the coil transport vehicle can be moved on this coil transport vehicle. As a result, the displaceable pressing element can be displaced or placed independently of a relative movement between the coil transport pallet and the coil transport vehicle with respect to the wound coil, whereby the coil/pallet unit can be produced more simply on the winding system.

The term "pallet moving device" here describes overall a device on the coil transport vehicle with the help of which the coil transport pallet can be moved vertically on the coil transport vehicle. In other words, this coil transport pallet can be lifted or lowered on the coil transport vehicle.

Preferably, the present pallet accommodation is a movable component of the pallet moving device, so that the pallet accommodation in the sense of the invention can be lifted or lowered.

The production of the coil/pallet unit can be designed even more advantageously if the displaceable pressing element and a pallet moving device of the coil transport vehicle are arranged so as to be linearly displaceable independently of one another with respect to the coil transport vehicle and with respect to a coil transport pallet accommodated by said coil transport vehicle. As a result, the displaceable pressing element can already be brought in operational contact with the wound coil when the coil transport pallet is still held a distance from the wound coil.

In the case at hand, the displaceable pressing element can be formed, for example, as driven or non-driven roller element or the like. However, other design variants are also possible.

Preferably, the displaceable pressing element is also adjustable horizontally for placement with different setting angles relative to the rotation axis of the wound coil and/or vertically for raising or lowering.

Preferably, the pressing mechanism or its displaceable pressing element is arranged on the mobile coil transport vehicle in such a manner that, in particular, the pressing element is arranged on the mobile coil transport vehicle so that it is displaceable relative to the coupling device formed at least partially by the mobile coil transport vehicle.

In the sense of the invention the term "coupling device" describes a device by means of which the coil transport pallet can be fixed in a particularly operational reliable manner on the pallet moving device, so that the coil transport pallet is very well secured with respect to unintended release.

Preferably, the coupling device is formed in such a manner that a centering of the coil transport pallet on the mobile coil transport vehicle can occur immediately.

An advantageous positioning of the wound coil can be achieved, for example, by different starting positions of the mobile coil transport vehicle.

The present displaceable pressing element of the pressing mechanism of the coil transport vehicle can interact from a structural standpoint in a particularly simple way with the coil wound on the winding system if the coil transport vehicle is characterized by a coil transport pallet on which the invention is based.

Moreover, the aim of the invention is also achieved by a device for discharging a coil wound on a winding system, in particular a coil wound from a steel strip, with a pressing mechanism for pressing at least one winding layer and/or winding layer end against the coil, wherein the pressing mechanism is arranged on a coil transport vehicle, in particular on a coil discharge carriage.

By means of the pressing mechanism arranged on the coil transport vehicle, the latter can interact from a structural standpoint in a particularly compact construction with the wound coil.

The device can be formed particularly advantageously if it includes a coil transport pallet according to one of the features described here and/or a coil transport vehicle according to one of the features described here.

The aim of the invention is also achieved by a method for discharging a coil wound on a winding system, in particular a coil wound from a steel strip, in which at least one winding layer and/or winding layer end of the wound coil is/are pressed by means of a pressing mechanism against the wound coil, in which the wound coil is deposited on a coil transport vehicle, in particular on a coil discharge carriage, in order to discharge this wound coil from the winding system and provide it for a further processing, wherein the method is characterized in that the pressing mechanism is provided by means of the coil transport vehicle on the winding system.

If the pressing mechanism is provided by the coil transport vehicle on the winding system, it can interact advantageously with a winding layer of the wound coil, which in turn is necessary for an operationally reliable production of a coil/pallet unit.

Preferably, from the coil transport vehicle, a displaceable pressing element of the pressing mechanism arranged on the coil transport vehicle is pressed through a coil transport pallet against the winding layer and/or winding layer end of the wound coil.

Thereby, a very compactly operating pressing mechanism can be implemented.

The displaceable pressing element can be pressed from a structural standpoint simply against the wound coil if a displaceable pressing element of the pressing mechanism arranged on the coil transport vehicle is pressed vertically from below against the winding layer and/or winding layer end of the wound coil.

The method can be varied particularly advantageously if a displaceable pressing element of the pressing mechanism arranged on the coil transport vehicle is pressed against the coil while the coil is rotated by means of a winding mandrel of the winding system. As a result, the winding layer end can be positioned very advantageously with respect to the support device.

In general, the present invention can be explained again in reference to a coil discharge and transport system of a coil wound on a winding system, in particular a coil wound from a steel strip, wherein the coil discharge and transport system is equipped with a plurality of coil transport pallets for the temporary accommodation of the wound coil, with at least one mobile coil transport vehicle for discharging and optionally transporting the wound coil and/or with a stationary ground conveyor device for transporting the wound coil, in which the coil wound on the winding system is deposited temporarily on the coil transport pallet, wherein the wound coil is positioned on the coil transport pallet with the assistance of a pressing mechanism for pressing at least one winding layer and/or winding layer end against the coil, in order to produce a coil/pallet unit in such a manner that the wound coil is prevented from unwanted springing open of the winding layers when it is deposited on the coil transport pallet.

In the sense of the invention, the term "coil discharge and transport system" describes a system with a discharge device, by means of which a strip wound on a winding system or the like can be discharged as a wound coil from the winding system and preferably transported further to temporary storage or to a downstream processing system and transferred there. This discharge device comprises at least the present coil transport pallet and the present coil transport vehicle.

To that extent, the present coil discharge and transport system or its discharge device for discharging the coil wound on the winding system functions excellently in combination with the present coil transport pallet and the present coil transport vehicle.

In the present case, the term "winding system" describes a system, by means of which a strip, in particular a steel strip, can be wound to form a coil, so that this coil can be accommodated for transport and/or temporary storage in an easier-to-manage and more space saving manner. In the prior art, other terms such as coiler etc. are also conventional alternatives to the expression "winding system."

Due to the fact that at least the outer winding layer or the outer strip end of the wound coil is pressed by the pressing mechanism against the wound coil, the wound coil can be deposited on the coil transport pallet in such a manner that the risk of unwanted springing opening of the winding of the wound coil can almost be excluded.

Advantageously, a use of a tying machine downstream of the winding process directly after the winding system can be dispensed with, whereby the transport of the coil wound on the winding system is considerably simplified.

This means that the wound coil taken up by a winding mandrel can subsequently be deposited directly onto the coil transport pallet.

Thus, a coil/pallet unit can be produced directly on the winding system and persist temporarily until the wound coil deposited on the coil transport pallet with the assistance of the pressing mechanism is in coil transport between the winding system and another processing system or temporary storage.

As a result, the risk of the wound coil being mechanically damaged during the tying by a tying machine is moreover reduced.

The present invention can be used particularly advantageously in connection with strip materials of high strength, since, when wound to form a coil, these strip materials have a tendency to spring open, so that, in this regard, special measures have to be taken during the tying of wound coils, which is in turn very expensive.

A preferred variant of the invention provides that a winding layer end of the wound coil is positioned on the winding system with respect to the pressing mechanism and/or the coil transport pallet in such a manner that the winding layer end is pressed by means of the pressing mechanism and/or coil transport pallet against the wound coil.

Preferably, the winding layer end is turned in a range of a 17:00 o'clock position or a 19:00 o'clock position, for example, by rotation of the winding mandrel, so that preferably first the pressing mechanism and then the coil transport pallet can be brought in operational contact with the winding layer end.

Furthermore, it is advantageous if just one coil transport pallet is associated with the wound coil for coil transport between the winding system and a further processing system and/or storage device. As a result, the transport of the wound coil can be further simplified significantly. Since the wound coil is received satisfactorily reliably by the coil transport pallet, transfer actions between two ground conveyor devices or the like can take place in an uncomplicated and quicker manner.

It should be understood that the coil transport of the wound coil or the coil/pallet unit can be designed in a variety of ways.

It is advantageous to design the coil transport so that the coil/pallet unit produced on the winding system is transferred by means of the mobile coil transport vehicle to the stationary ground conveyor device, in order to transport just this coil/pallet unit to a storage device and/or a further processing system.

It is particularly advantageous if the coil/pallet unit produced on the winding system is first undone again for transfer to a further processing installation and/or to a storage device, in order to transfer the coil deposited temporarily on the coil transport pallet to the further processing system and/or to the storage device.

Preferably, the coil/pallet unit here persists unchanged.

In other words, this means that once the wound coil has been deposited on the coil transport pallet, it is not taken off the coil transport pallet again and rearranged before the coil/pallet unit has reached the further processing system or a temporary storage.

The wound coil can very advantageously be moved by means of the coil/pallet unit produced, if the coil/pallet unit produced on the winding system is rotated during coil transport on the stationary ground conveyor device at least once about a vertical axis.

It is understood that the present pressing mechanism can interact in quite diverse spatial positions and quite diverse ways with the outer winding layer or with the strip end area of the outer winding layer, in order to be able to deposit the wound coil in a particularly tightly wound state on the coil transport pallets.

The present coil transport vehicle can be designed differently. Preferably, it is constructed as a coil discharge carriage, by means of which the wound coil can be discharged from the winding system and transferred to the stationary ground conveyor device.

In this connection, it is advantageous if the mobile coil transport vehicle comprises a railbound coil discharge carriage, since thereby from a structural standpoint a particularly simple and operationally reliable discharge of the wound coil on the winding system can be ensured.

The invention can be used in a wide variety of systems such as, for example, on a rolling mill for rolling strips, in particular steel strips, with at least one winding system for winding strips, which is downstream of at least one rolling device of the rolling mill. As a result, the operation of the rolling mill can be substantially improved overall.

Furthermore, in the process, the wound coil is then arranged on the coil transport pallet in such a manner that a coil/pallet unit is produced, which ideally does not have to be undone for downstream coil transport to further processing or temporary storage of the wound coil. To that extent, the discharge of the wound coil can occur in such a manner that a repeated transfer of the wound coil without coil transport pallet does not apply, whereby the risk of damaging the coil can be nearly excluded. For this purpose, the wound coil is preferably received, already in the coil system, by a special coil transport pallet. Subsequently, the wound coil is discharged or moved out of the winding system together with the coil transport pallet as coil/pallet unit by means of a coil discharge carriage and, for example, transported further to another processing or treatment station. This is made possible, on the one hand, by the special production of the present coil/pallet unit with the assistance of a pressing mechanism and, on the other hand, by the special design of the coil transport pallet and also its interaction with the mobile coil transport vehicle.

By means of the present invention, almost any strip materials to be wound and any coil thicknesses and diameters can be processed.

Additional features, effects and advantages of the present invention are explained in reference to the appended drawing and the description below in which, as an example, a first possible coil transport pallet, a first possible coil transport vehicle and to that extent also a first possible device for discharging a coil wound on a winding system as well as, for example, an associated coil discharge and transport system are represented and described.

Figure 2:
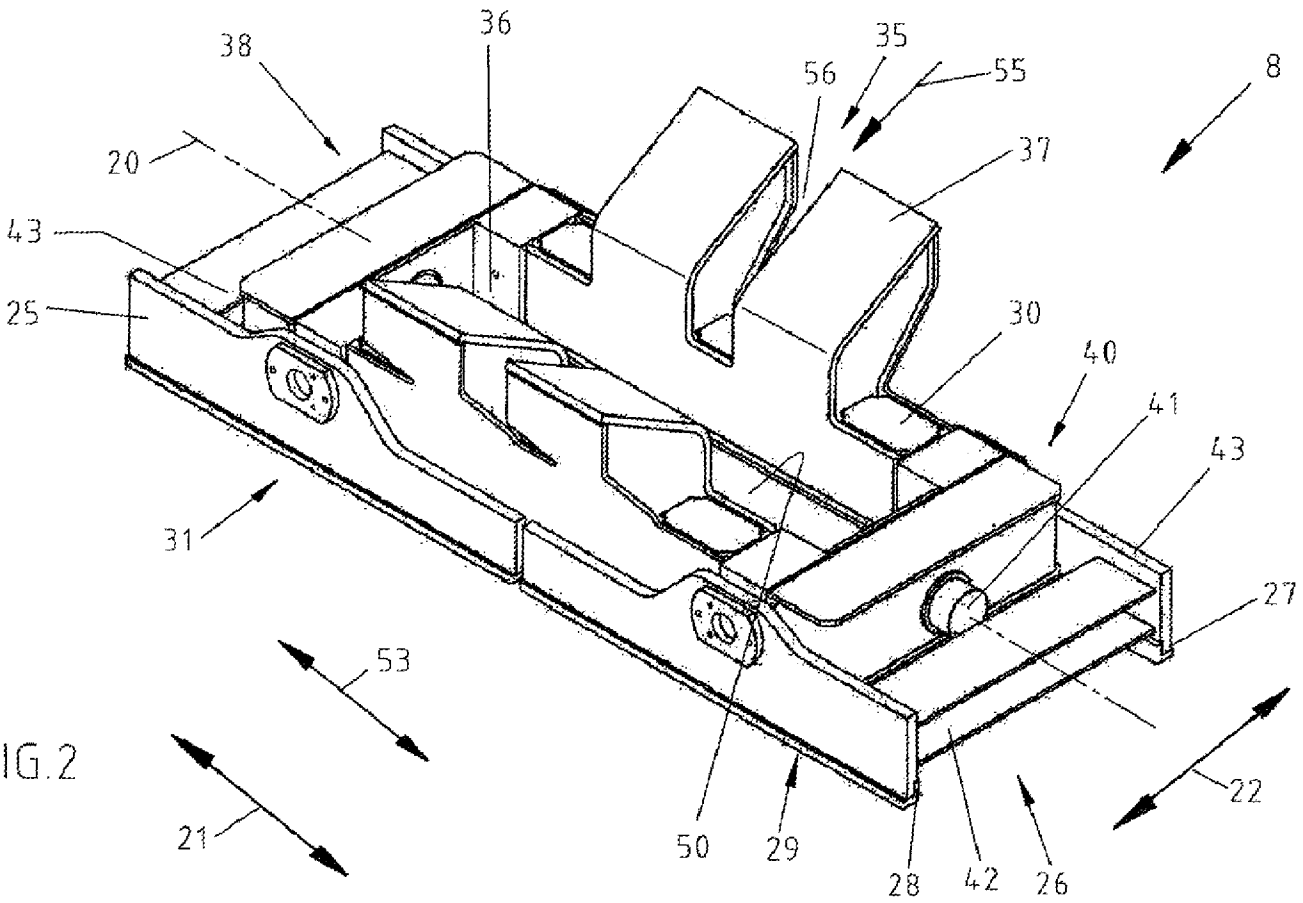
Figure 3:
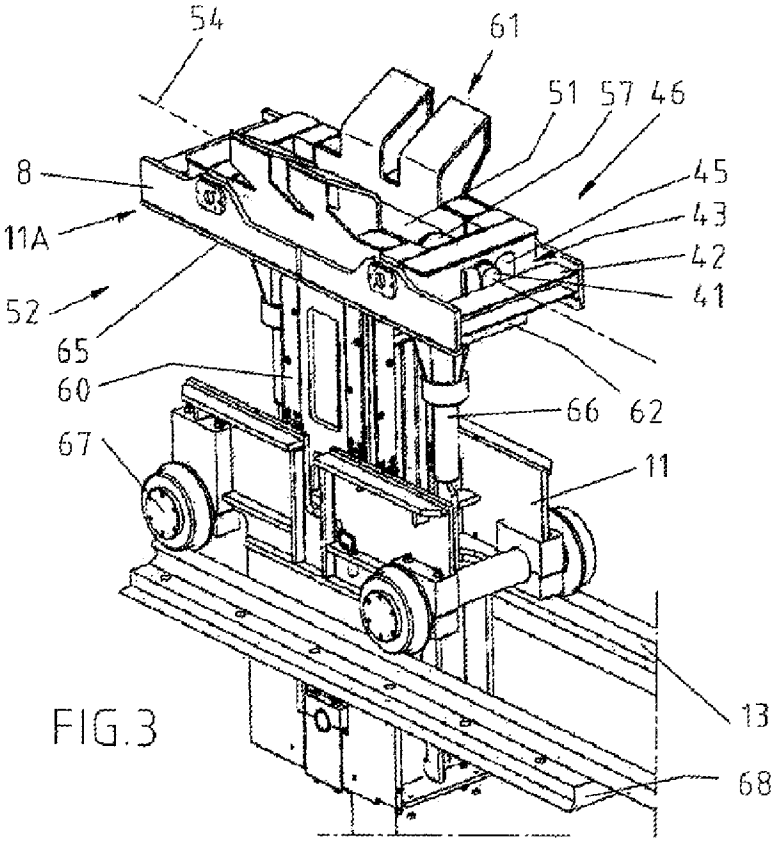

In the drawing:

FIG. 1 diagrammatically shows a view of three winding systems for winding a respective coil, with a respective device for discharging a coil/pallet unit produced on the coil winding system;

FIG. 2 diagrammatically shows a perspective view of a coil transport pallet with a through-opening for guiding through of a pressing element of a pressing mechanism for pressing at least one winding layer and/or winding layer end against the wound coil;

FIG. 3 diagrammatically shows a perspective view of a coil transport vehicle equipped with a pressing mechanism, with the coil transport pallet shown in FIG. 2

Figure 4:
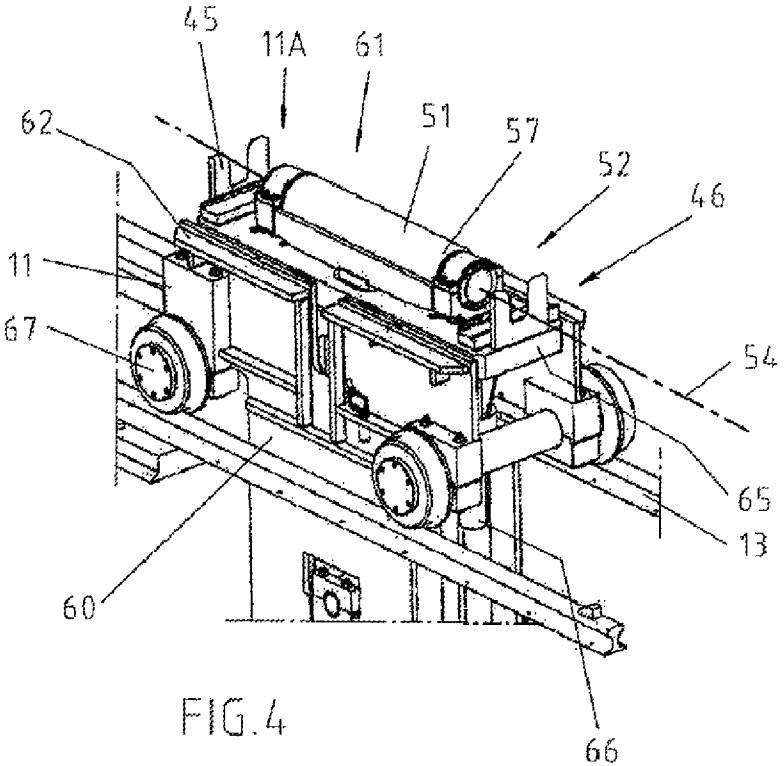
Figure 5:
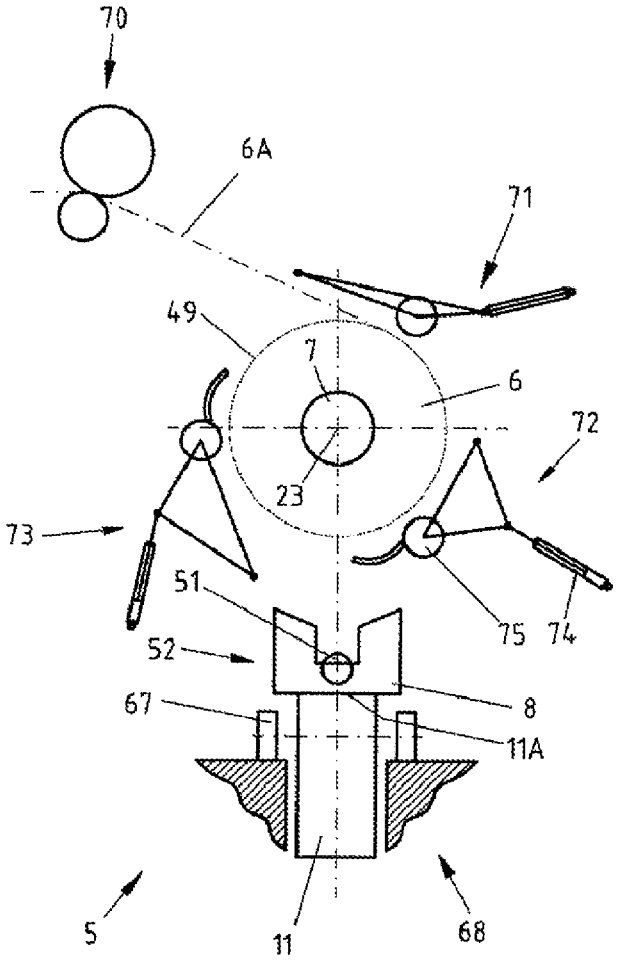
Figure 7:
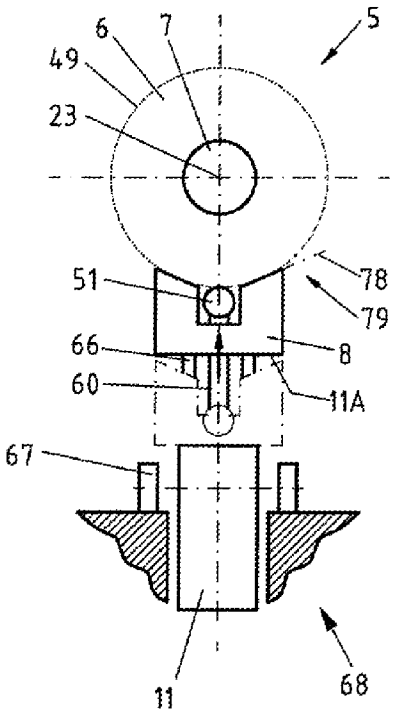
Figure 6:
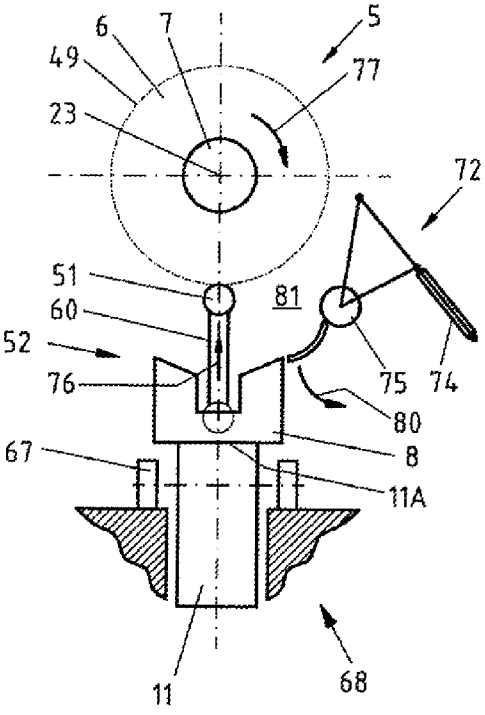

FIG. 4 diagrammatically shows a perspective view of the mobile ground conveyor vehicle without coil transport pallet;

FIG. 5 diagrammatically shows a front view of one of the winding systems shown in FIG. 1 with the device for discharging the coil/pallet unit;

FIG. 6 diagrammatically shows a front view according to FIG. 5 with the pressing element displaced through the through-opening up to the wound coil;

FIG. 7 diagrammatically shows another front view according to FIGS. 5 and 6 with the pressing element displaced through the through-opening up to the wound coil and with the coil transport pallet moved up to the wound coil;

FIG. 8 diagrammatically again shows a front view according to FIGS. 5 to 7 with the coil/pallet unit produced, which is supported by the coil transport vehicle, with vertically downward moved/displaced pressing element.

The coil delivery and transport system 1 shown in FIG. 1 as an example and therefore also only partially comprises three winding systems 2, 3, 4 which, at least in this embodiment example shown, are downstream of a rolling mill, not further represented, for rolling steel strips or the like.

However, these winding systems 2, 3 or 4 can also be provided on other system areas or systems such as, in particular, other forming systems or the like.

Each of the winding systems 2, 3 and 4 has a device 5 for discharging a coil 6 wound on the winding system 2, 3 or 4, which is shown and described in greater detail in FIGS. 5 to 8.

By means of the winding systems 2, 3 and 4, strips provided, such as, in particular, steel strips 6A (see FIG. 5), are wound compactly on their respective winding mandrels 7 (numbered only exemplarily) to form the coil 6.

The coil discharge and transport system 1 moreover comprises coil transport pallets 8 (see, in particular, FIG. 2) in order to be able to deposit on each one of these coil transport pallets 8 in each case a wound coil 6 in an operationally reliable manner so that, on the respective winding system 2, 3 and 4, a coil/pallet unit 10 can be produced at the same time.

The respective coil transport pallet 8 is provided by a mobile coil transport vehicle 11 with a pallet accommodation 11A (see, in particular, FIGS. 3 and 4) on each of the winding systems 2, 3 or 4.

The coil transport vehicle 11 is here designed as a railbound coil discharge carriage 11 which can be moved along a rail section 13, in order to produce a coil/pallet unit 10 from the coil 6 wound on the winding system 2, 3 or 4 and the associated provided coil transport pallet 8.

Subsequently, the latter is discharged by means of the coil transport vehicle 11 from the winding system 2, 3 or 4 and optionally transferred to a downstream stationary ground conveyor device 15.

Furthermore, at least in this embodiment example, the coil discharge and transport system 1 additionally also comprises the stationarily installed ground conveyor device 15, by means of which the respective coil/pallet unit 10 can be transported from the winding system 2, 3 or 4 or from the corresponding coil discharge carriage 11 to a further processing system (not shown) and/or a storage device (not shown).

The stationarily installed ground conveyor device 15 is characterized by roller table lane 16 (numbered only exemplarily) inter alia as well as by rotating table units 17 (also numbered only exemplarily), so that, in particular, the respective coil/pallet unit 10 can be transported in different transport directions.

For this purpose, the respective coil/pallet unit 10 produced on the winding system 2, 3 or 4 can be rotated during coil transport around a vertical axis 18, so that the wound coil 6 deposited on the respective coil transport pallet 8 can always be moved or transported as coil/pallet unit 10 within the coil transport system 1 from the respective winding system 2, 3 or 4 to the target site. In the process, this coil/pallet unit 10 is not undone on the way, so that the wound coil 6 is always reliably parked on the coil transport pallet 8.

The coil transport pallet 8 shown in further detail in FIG. 2 has, in the direction of its longitudinal axis 20, a longitudinal extent 21 which is considerably longer than its transverse extent 22. In particular, the wound coil 6 lies on the coil transport pallet 8 in such a manner that the coil rotation axis 23 (see FIGS. 5 to 8) of the wound coil 6 is oriented substantially in the same way as the longitudinal axis 20.

In the design shown here as an example, the coil transport pallet 8 has an outer runner frame 25 which, on the lower side 26, of the coil transport pallet 8, forms a first runner 27 located on the left next to the longitudinal axis 20 and an additional runner 28 located on the right next to the longitudinal axis 20.

To that extent, the coil transport pallet 8 is designed without rollers.

The runners 27 and 28 form their own rolling and/or sliding surfaces 29 (numbered only exemplarily), so that the coil transport pallet 8 can be transported by means of these runners 27 and 28 excellently along the roller table lanes 16 of the stationary ground conveyor device 15.

The coil transport pallet 8 moreover has an inner frame 30 which together with the outer runner frame 25 forms a framework 31 of the coil transport pallet 8.

By means of the inner frame 30, a support device 35 for temporarily supporting the wound coil 6 is substantially formed.

The support device 35 is designed in the shape of a trough, so that in the trough 36 or depression (not numbered) thereof the wound coil 6 can be reliably deposited.

Here, the support device 35 comprises at least two bar elements 37 (numbered exemplarily), which substantially form the trough 36. On these bar elements 37, the wound coil 6 can be deposited.

A coil accommodation space 38, located particularly deep in the coil transport pallet 8, can be formed on the coil transport pallet 8 by the trough 36.

Moreover, the coil transport pallet 8 is characterized by a coupling unit 40, by means of which it can be reliably coupled temporarily to the coil transport vehicle 11.

This coupling unit 40 comprises, on the one hand, a coupling peg parts 41 (numbered only exemplarily) which are arranged on the inner frame 30 and extend in the direction of the longitudinal axis 20 of the coil transport pallet 8.

On the other hand, this coupling unit 40 has transverse member parts 42 (numbered only exemplarily) which are formed by the outer runner frames 25 and which extend transversely to the longitudinal axis 20 of the coil transport pallet 8.

Here, the transverse member parts 42 of the inner frame 30 or of the coupling peg parts 41 are arranged axially spaced in such a manner that a coupling space 43 forms in between, in particular in the front and in the rear on the coil transport pallet 8.

In these coupling spaces 43, coupling elements 45 of a coupling device 46 of the coil transport vehicle 11 can engage (see FIGS. 3 and 4).

The coupling device 46 thus comprises the coupling elements 45 (numbered only exemplarily) which can cooperate with the complementarily constructed coupling unit 40 on the respective coil transport pallet 8.

Here, these coupling elements 45 interact with the coupling peg parts 41 of the coil transport pallet 8 in such a manner that the coil transport pallet 8 is coupled so that it cannot shift in transverse direction relative to the longitudinal axis 20 on the coil transport vehicle 11.

In addition, the coupling elements 45 interact, on the one hand, with the inner frame 30 and, on the other hand, with the transverse member parts 42 in such a manner that the coil transport pallet 8 is coupled axially to the longitudinal axis 20 so that it cannot shift on the coil transport vehicle 11.

However, in order to be able then to press a winding layer 49 (see FIGS. 5 to 8) of the wound coil 6 in the sense of the invention through the coil transport pallet 8 onto said wound coil 6, the coil transport pallet 8 is equipped with a through-opening 50 for guiding a displaceable pressing element 51 of a pressing mechanism 52 therethrough, for pressing at least one winding layer 49 and/or winding layer end 78 (see FIGS. 7 and 8) against the coil 6.

To that extent, the coil transport pallet 8 is designed with a pressing element through-opening 50 which, in particular, is adjusted to the size of the displaceable pressing element 51 in such a manner that said pressing element can be guided without problem from below through the coil transport pallet 8 up to the wound coil 6.

Thus, the displaceable pressing element 51 is arranged on the coil transport vehicle 11 in such a manner that it can be displaced through the through-opening 50 in order to interact with the wound coil 6.

To that extent, with the aid of the pressing mechanism 52, the wound coil 6 can be deposited on the coil transport pallet 8 in such a manner that the winding of the respective coil 6, which is produced on the winding system 2, 3 or 4, can no longer spring open later due only to interaction with the coil transport pallet 8 on which the wound coil is deposited. As a result, it is advantageously possible to dispense with additional tying machines or the like for fixing the winding of the wound coil directly after the winding system.

The through-opening 50 is arranged between two coupling spaces 43 of the coupling unit 40, which are spaced from one another by the through-opening 50, as well as between two runners 27 and 28 spaced from one another by the through-opening 50 and forming the rolling and/or sliding surfaces 29.

Furthermore, the through-opening 50 is arranged beneath the support device 35 and on the lower side 26 of the coil transport pallet 8. As a result, the pressing mechanism 52 can advantageously be arranged directly on the coil transport vehicle 11.

The shiftable pressing element 51 can be displaced without problem up to the wound coil 6, if the through-opening 50 is arranged in the trough 36 of the support device 35, since, by means of the trough 36, the wound coil 6 can be placed particularly deep in the coil transport pallet 8. Thereby, the wound coil 6 is placed in the immediate vicinity of the displaceable pressing element 51.

The through-opening 50 extends with its longitudinal orientation 53 in the direction of the longitudinal extent 21 of the coil transport pallet 8 or of the coil accommodation space 38.

Furthermore, the longitudinal orientation 53 of the through-opening 50 extends in the direction of the coil rotation axis 23 of the wound coil 6 and, in addition, in the direction of the rotation axis 54 of the pressing element 51, wherein the coil rotation axis 23 and the rotation axis 54 extend axially parallel to one another. Thereby, the pressing element 51, which is displaceable through the through-opening 50, can interact through the through-opening 50 in a constructively simple manner with the wound coil 6.

The through-opening 50 moreover extends transversely to a coil tying device 55 or coil tying opening 56 provided on the coil transport pallet 8, with the help of which additionally the wound coil 6 can be tied if this is desired.

In this embodiment example, the coil tying opening 56 is between two bar elements 37 of the support device 35, which are spaced from one another axially along the longitudinal axis 20.

As can be seen clearly in the representations of FIGS. 3 and 4, the respective pressing mechanism 52 can be arranged in this embodiment example directly on the respective coil transport vehicle 11 or coil discharge carriage 11, so that each coil transport vehicle 11 can work independently with respect to the pressing of the wound coil 6.

Here, the pressing mechanism 52 is formed in such a manner that at least the displaceable pressing element 51, which is implemented, for example, in the form of a roller element and, in particular, in the form of a trough roller element 57, can be displaced relative to the respective coil transport vehicle 11 and brought in mechanical operational contact with the outer winding layer 49 of the wound coil 6.

As already described, the displaceable pressing element 51 is mounted such a manner that it is linearly displaceable with respect to the coil transport vehicle 11 on said coil transport vehicle 11.

In order to be able to displace the displaceable pressing element 51 in particular vertically with respect to the coil transport pallet 8 or the coil/pallet unit 10, the pressing mechanism 52 comprises a corresponding lifting device 60 which is arranged in the center on the coil transport vehicle 11.

On its side 61 facing the coil transport pallet 8, the coil transport vehicle 11 comprises a pallet moving device 65, wherein the present pallet accommodation 11A is an upper component of the pallet moving device 65 of the coil transport vehicle 11 on which the coil transport pallet 8 is deposited.

In this embodiment example, the pallet accommodation 11A is formed as frame part 62 which surrounds in particular the displaceable pressing element 51 of the pressing mechanism 52 arranged on the coil transport vehicle 11.

By means of the pallet moving device 65 thus formed, the coil transport pallet 8 can be lifted independently of the displaceable pressing element 51 to a position under the wound coil 6, so that the coil 6 which then interacts with the coil transport pallet 8 can optionally also be pulled off the winding mandrel 7 by means of the coil transport vehicle 11 and discharged as coil/pallet unit 10 from the winding system 2, 3 or 4.

The pallet moving device 65 for this purpose can be moved vertically by means of a lifting device 66.

For the rest, the coil transport vehicle 11 also comprises four wheel elements 67 (numbered only exemplarily), by means of which it can be moved in a mobile manner along a discharge section 68.

According to the representation of FIG. 3, the coil transport vehicle 11 is shown in an extended state with respect to the lifting device 66, wherein the coil transport pallet 8 is coupled to the pallet accommodation 11A of the coil transport vehicle 11. In the process, the pressing element 51 is displaced from below far into the trough 36 and can thus come in contact early on with the outer winding layer 49 or with the winding layer end area 78 (see FIGS. 7 and 8) and be pressed against the wound coil 6.

According to the representation of FIG. 4, the coil transport vehicle 11 is shown alternatively also without coil transport pallet 8 and in a retracted state with respect to the lifting device 66.

Based on the discharge device 5 shown in greater in detail in a front view in FIGS. 5 to 8, an exemplary method sequence is shown and explained, which can be implemented with the special coil transport pallet 8 or with the coil transport vehicle 11.

The wound coil 6 is here still held by the winding mandrel 7 on one of the winding systems 2, 3 or 4.

The discharge device 5 comprises, in particular, the coil transport vehicle 11 which can be placed beneath the winding mandrel 7 or the wound coil 6 and which is parked with the coil transport pallet 8 already under the wound coil 6 while the coil 6 is still in the process of being completely wound.

To the extent that the pressing mechanism 52 is provided by means of the coil transport vehicle 11 on the winding system 2, 3 or 4.

As shown in the representation according to FIG. 5, the steel strip 6A is supplied in a known manner from the top left to the winding mandrel 7 by means of a feed device 70.

Concentrically around the winding mandrel 7, three deflection and pressing devices 71, 72 and 73 are arranged, by means of which the winding process can be facilitated in a known way. The three deflection and pressing devices 71, 72 and 73 can thus be designed as so-called deflection shells.

Each of the deflection devices 71, 72, 73 comprises a delivery mechanism 74 (numbered only exemplarily) by means of which, if needed, the deflection and pressing rollers 75 (also numbered only exemplarily) can be delivered to the coil 6 to be wound.

In particular, if the steel strip 6A is cut, the winding layers 49 of the wound coil 6 can be held together by means of these deflection and pressing rollers 75, so that the wound coil 6 is secured against unwanted springing open.

According to the representation of FIG. 5, the displaceable pressing element 51 of the pressing mechanism 52 of the coil transport vehicle 11 is still retracted downward into the coil transport vehicle 11. The same applies with regard to the pallet moving device 65.

According to the representation of FIG. 6, the displaceable pressing element 51 is already displaced through the coil transport pallet 8 in vertical direction 76 vertically upward in the direction of the wound coil 6, in particular, to the point that it presses the outer winding layer 49 against the wound coil 6 (in the broken-line representation of the displaceable pressing element 51, it is shown still in the lower position).

The steel strip 6A has already been cut by a cutting device (not shown) or it is cut now, and, in particular, the outer winding layer 49 of the completely wound coil 6 is now pressed in particular by the displaceable pressing element 51 against the completely wound coil 6, so that it is ensured that the wound coil 6 cannot spring open accidentally.

Figure 8:
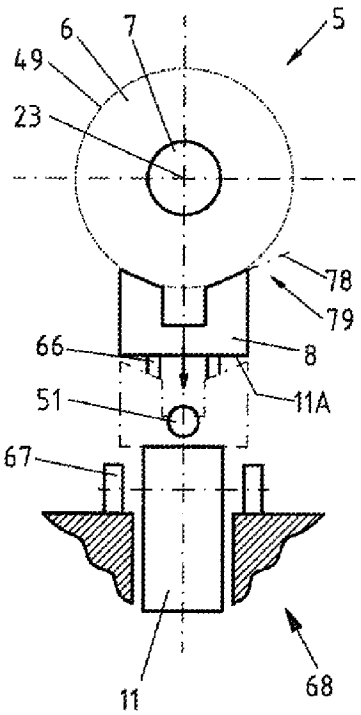

The wound coil 6 is rotated further in accordance with rotation direction 77 until the winding layer end 78 is located approximately in the 17:00 o'clock position 79 (see, in particular, FIGS. 7 and 8).

If the winding layers 49 of the wound coil 6 are satisfactorily secured by the displaceable pressing element 51 of the pressing mechanism 52 of the coil transport vehicle 11, the right lower deflection and pressing device 72 is moved by a swiveling movement 80 from the area of action 81 of the coil transport vehicle 11 so that then, by means of the hydraulically operating lifting device 66, the coil transport pallet 8 supported by the pallet moving device 65 can be moved from below against the wound coil 6 in such a manner that the wound coil 6 is deposited on the coil transport pallet 8 as shown according to the representation of FIG. 7 (the broken-line representation of the coil transport pallet 8 shows this coil transport pallet still in the lower position).

If the wound coil 6 is now supported operationally reliably by the support device 35 of the coil transport pallet 8, the displaceable pressing element 51 can again be displaced in the direction of the coil transport vehicle 11 vertically downward, as illustrated according to the representation of FIG. 8.

The wound coil 6 is now deposited on the wound transport pallet 8 in such a manner that a springing open of the wound coil 6 is impossible due to the contact with the coil transport pallet 8 is impossible.

The load of the wound coil 6 is taken up completely by the coil transport pallet 8, so that, in the winding system 2, 3 or 4 and with the aid of the lifting device for the pallet 66, the respective coil/pallet unit 10 is produced.

The wound coil 6, together with or using the coil transport pallet 8, can thus be pulled from the winding mandrel 7 with the aid of the coil transport vehicle 11 and discharged from the winding system 2, 3 or 4. If the wound coil 6 is free of the winding mandrel 7, the lifting device 66 is retracted again, and the coil transport pallet 8 or the coil/pallet unit 10 is lowered. Subsequently, the wound coil 6 is transferred to the stationary ground conveyor device 15, as already explained at the start.

The coil/pallet unit 10 is rotated, during subsequent transport, on the rotating table unit 17 of the stationary ground conveyor device 15 by 90° about the vertical axis 81. To that extent, the coil/pallet unit 10 undergoes a change in direction on the rotating table unit 17 and accordingly can be transported further to a destination site, without the wound coil having to be taken off the coil transport pallet 8 once associated.

Subsequently, with the aid of the rotation table unit 17 and the coil transport vehicle 11, a new coil transport pallet 8 is moved to a position under the winding mandrel 7 of the respective winding system 2, 3 or 4, so that, with the assistance of the pressing mechanism 20, a new coil/pallet unit 10 can be produced there.

Here, it is pointed out explicitly that the features of the solutions provided above and described in the claims and/or figures can optionally also be combined, so as to be able accordingly to cumulatively implement or achieve the explained features, effects and advantages.

It should be understood that the above explained embodiment example is only a first design of the coil transport pallet or of the coil transport vehicle. To that extent, the design of the invention is not limited to this embodiment example.

All the features disclosed in the application documents are claimed as essential to the invention, to the extent that they are novel separately or in combination with respect to the prior art.

LIST OF REFERENCE NUMERALS

1 Coil delivery and transport system
2 First winding system
3 Second winding system
4 Third winding system
5 Delivery device
6 Wound coil
6A Steel strips
7 Winding mandrel
8 Coil transport pallets
10 Coil/pallet unit
11 Mobile coil transport vehicle, in particular coil delivery carriage
11A Pallet accommodation
13 Rail section
15 Stationary ground conveyor device
16 Roller table lane sections
17 Rotating table units
18 Height or vertical axis
20 Longitudinal axis
21 Longitudinal extent
22 Transverse extent
23 Coil rotation axis
25 Outer runner frame
26 Lower side
27 First runner
28 Other runner
29 Rolling and/or sliding surfaces
30 Inner frame
31 Framework
35 Support device
36 Trough
37 Bar elements
38 Coil accommodation space
40 Coupling unit
41 Coupling peg parts
42 Transverse member parts
43 Coupling spaces
45 Coupling elements
46 Coupling device
49 Winding layer
50 Through-opening
51 Pressing element
52 Pressing mechanism
53 Longitudinal orientation
54 Rotation axis
55 Coil tying device
56 Coil tying opening
57 Trough roller element
60 Lifting device for pressing elements
61 Side
62 Frame part
65 Pallet moving device
66 Lifting device for pallet
67 Wheel element
68 Discharge section
70 Feed device
71 Upper deflection and pressing device
72 Right lower deflection and pressing device
73 Left lower deflection and pressing device
74 Delivery mechanism

75 Deflection and pressing rollers
76 Vertical direction
77 Rotation direction
78 Winding layer end
79 17:00 o'clock position
80 Swiveling movement
81 Area of action

The invention claimed is:

1. A system, comprising:

a coil transport vehicle (11) having a pallet accommodation (11A) for accommodating a coil transport pallet (8) for transporting a wound coil (6), the coil transport pallet (8) having a support device (35) for temporarily supporting the wound coil (6), a coupling unit (40) for coupling to the coil transport vehicle, and a through-opening (50); and characterized in that the coil transport vehicle (11) has a pressing mechanism (52) with a pressing element (51) displaceably supported on the coil transport vehicle (11) and guided from below through the through-opening of the coil transport pallet for applying pressure to at least one wound layer (49) against the wound coil (6).

2. The system according to claim 1, characterized in that the through-opening (50) is arranged between two coupling spaces (43) of the coupling unit (40) spaced from one another by the through-opening (50) and/or between two runners (27, 28) spaced from one another by the through-opening (50) and forming the rolling and/or sliding surfaces (29).

3. The system according to claim 1, characterized in that the through-opening (50) is arranged beneath the support device (35).

4. The system according to any one of claim 1, characterized in that the through-opening (50) is arranged in a trough (36) of the support device (35).

5. The system according to any one of claim 1, characterized in that the through-opening (50) has a longitudinal orientation (53) which is oriented in the direction of the longitudinal extent (21) of the coil transport pallet (8).

6. The system according to claim 1, characterized in that the coil transport vehicle (11) has a pallet moving device (65), the pressing mechanism (52) with the displaceable pressing device (51) being supported on the coil transport vehicle (11) for linear displacement relative to the pallet moving device (65) of the coil transport vehicle (11), whereby the coil transport pallet (8) received by the coil transport vehicle (11), is displaceable on the coil transport vehicle (11) by the pallet moving device (65).

7. The system according to claim 6, characterized in that the displaceable pressing element (51) and the pallet moving device (65) of the coil transport vehicle (11) are arranged in such a manner that they can be linearly moved independently of another on the coil transport vehicle (11) with respect to the coil transport vehicle (11) and with respect to a coil transport pallet (8) received by said coil transport vehicle (11).

8. A coil transport vehicle (11), comprising a coil delivery carriage, with a pallet accommodation (11A) for accommodating a coil transport pallet (8), and with a pallet moving device (65), characterized in that the coil transport vehicle (11) comprises a pressing mechanism (52) with a displaceable pressing element (51) for pressing at least one winding layer (49) against the wound coil (6), wherein the displaceable pressing element (51) is mounted displaceably with respect to the coil transport vehicle (11), and wherein the displaceable pressing element (51) and the pallet moving device (65) of the coil transport vehicle (11) are arranged in such a manner that they can be linearly moved independently of another on the coil transport vehicle (11) with respect to the coil transport vehicle (11) and with respect to the coil transport pallet (8) received by said coil transport vehicle (11) in order to bring the pressing element (51) into contact with the wound coil (6) when the coil transport pallet (8) is still spaced from the wound coil (6).

9. The coil transport vehicle (11) according to claim 8, characterized in that the displaceable pressing element (51) is arranged linearly displaceably on the coil transport vehicle (11), in such a manner that it is displaceable through a through-opening (30) formed on the coil transport pallet (8).

10. The coil transport vehicle (11) according to claim 8, characterized in that the displaceable pressing element (51) is arranged opposite a pallet moving device (65) of the pallet transport vehicle (11) in such a manner that it is linearly displaceable on the coil transport vehicle (11), wherein a coil transport pallet (8) received by the coil transport vehicle (11) can be moved on said coil transport vehicle (11) by the pallet moving device (65).

11. A method for discharging a coil (6) wound on a winding system (2, 3, 4) from a steel strip (6A), in which the wound coil (6) is deposited by means of the coil transport pallet (8) onto a coil transport vehicle (11) formed as a coil delivery carriage (11), in order to discharge this wound coil (6) from the winding system (2, 3, 4) and provide it for further processing, characterized in that;

at least one winding layer (49) of the wound coil (6) is pressed by a pressing mechanism (52, 71, 72, 73) against the wound coil (6), that the pressing mechanism (52) is provided on the winding system (2, 3, 4) by the coil transport vehicle (11), and that a displaceable pressing element (51) of the pressing mechanism (52) arranged on the coil transport vehicle (11) is pressed from below through a through-opening (50) in a coil transport pallet (8) against the winding layer (49) of the wound coil (6).

* * * * *